US008402758B2

(12) United States Patent
Castner et al.

(10) Patent No.: US 8,402,758 B2
(45) Date of Patent: Mar. 26, 2013

(54) EXHAUST DIFFUSER

(75) Inventors: James Castner, Lake Forest Park, WA (US); Michael A. Waggoner, Seattle, WA (US)

(73) Assignee: PACCAR Inc, Bellevue, WA (US)

( * ) Notice: Subject to any disclaimer, the term of this patent is extended or adjusted under 35 U.S.C. 154(b) by 278 days.

(21) Appl. No.: 12/718,598

(22) Filed: Mar. 5, 2010

(65) Prior Publication Data

US 2011/0214419 A1 Sep. 8, 2011

(51) Int. Cl.
*F01N 1/00* (2006.01)

(52) U.S. Cl. ..... 60/322; 60/317; 60/324

(58) Field of Classification Search ..... 60/322, 60/317, 324; 181/227, 228, 239, 240, 264
See application file for complete search history.

(56) References Cited

U.S. PATENT DOCUMENTS

| | | | | |
|---|---|---|---|---|
| 1,978,676 | A | 10/1934 | Kurth | |
| 2,975,854 | A | 3/1961 | Bakke | |
| 4,159,078 | A | 6/1979 | Diermayer | |
| 5,058,703 | A * | 10/1991 | Ealba et al. | 181/228 |
| 6,367,580 | B1 * | 4/2002 | Chang | 181/241 |
| 7,073,625 | B2 * | 7/2006 | Barth | 181/240 |
| 7,316,109 | B2 | 1/2008 | Clerc | |
| 2005/0045419 | A1 * | 3/2005 | Choi et al. | 181/270 |
| 2005/0139417 | A1 * | 6/2005 | Quast | 181/227 |
| 2007/0095057 | A1 * | 5/2007 | Field et al. | 60/317 |
| 2007/0144158 | A1 | 6/2007 | Girard | |
| 2007/0163247 | A1 | 7/2007 | Ryan | |
| 2007/0163249 | A1 * | 7/2007 | Clerc et al. | 60/320 |
| 2008/0099276 | A1 * | 5/2008 | Bach | 181/227 |
| 2008/0115989 | A1 | 5/2008 | Matte | |
| 2008/0116005 | A1 | 5/2008 | Matte | |
| 2009/0013675 | A1 * | 1/2009 | Troxler | 60/319 |
| 2009/0014235 | A1 * | 1/2009 | Troxler | 181/228 |
| 2009/0120066 | A1 * | 5/2009 | VanderGriend et al. | 60/285 |
| 2009/0145119 | A1 | 6/2009 | Farrell | |

* cited by examiner

*Primary Examiner* — Thomas Denion
*Assistant Examiner* — Jason Shanske
(74) *Attorney, Agent, or Firm* — Christensen O'Connor Johnson Kindness PLLC

(57) ABSTRACT

A flow diffuser for vehicles of the type having an engine and an exhaust pipe generally includes a body including a plurality of inner diffusion ports extending through the body, wherein the body may be attached to an exhaust pipe at or near the exit plane of the exhaust pipe, wherein the body is sized to have a cross-sectional area that is smaller than the cross-sectional area of the exit plane of the exhaust pipe to create a plurality of outer diffusion ports around at least a portion of the outer perimeter of the body when coupled to the exhaust pipe, and one or more extension flaps extending from at least a portion of the outer perimeter of the body.

10 Claims, 5 Drawing Sheets

EXHAUST DIFFUSER

BACKGROUND

New, more stringent emission limits for diesel engines necessitate the use of exhaust after-treatment devices, such as diesel particulate filters. Certain after-treatment devices include a regeneration cycle. During the regeneration cycle, the temperature of the exhaust gas plume may rise significantly above acceptable temperatures normally experienced by exhaust systems without such after-treatment devices. As an example, exhaust systems without after-treatment devices typically discharge exhaust gas at a temperature of around 650 degrees Kelvin. An exhaust system having an after-treatment device that includes a regeneration cycle may experience an exhaust gas plume temperature exceeding 900 degrees Kelvin at its center core. Exhaust gas at this high exit temperature creates a potentially hazardous operating environment.

Prior art and current exhaust pipe diffusers are not designed to optimally intermingle cooling air with a hot core stream in the center of the exhaust pipe, as described above. The result at the exit plane can be a cool ring of exhaust flow surrounding a very hot exhaust core.

Thus, there exists a need for a flow diffuser for an exhaust pipe for diffusing hot exhaust gas on exit from an exhaust pipe.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, a flow diffuser for vehicles of the type having an engine and an exhaust pipe is provided. The flow diffuser generally includes a body including a plurality of inner diffusion ports extending through the body, wherein the body may be attached to an exhaust pipe at or near the exit plane of the exhaust pipe, wherein the body is sized to have a cross-sectional area that is smaller than the cross-sectional area of the exit plane of the exhaust pipe to create a plurality of outer diffusion ports around at least a portion of the outer perimeter of the body when coupled to the exhaust pipe. The flow diffuser further includes one or more extension flaps extending from at least a portion of the outer perimeter of the body.

In accordance with another embodiment of the present disclosure, a flow diffuser for vehicles of the type having an engine and an exhaust pipe is provided. The flow diffuser generally includes a body including a plurality of inner diffusion slots extending through the body, wherein the body may be attached to an exhaust pipe at or near the exit plane of the exhaust pipe, wherein the body is sized to have a cross-sectional area that is smaller than the cross-sectional area of the exit plane of the exhaust pipe to create a plurality of outer diffusion ports around the outer perimeter of the body when coupled to the exhaust pipe, wherein the body is substantially rectangular in shape. The flow diffuser further includes one or more extension flaps extending from at least a portion of the outer perimeter of the body.

DESCRIPTION OF THE DRAWINGS

The patent or application file contains at least one figure executed in color. Copies of this patent or patent application publication with color figures will be provided by the Office upon request and payment of the necessary fee.

The foregoing aspects and many of the attendant advantages of this disclosure will become more readily appreciated as the same become better understood by reference to the following detailed description, when taken in conjunction with the accompanying drawings, wherein.

DETAILED DESCRIPTION

Figure 1:
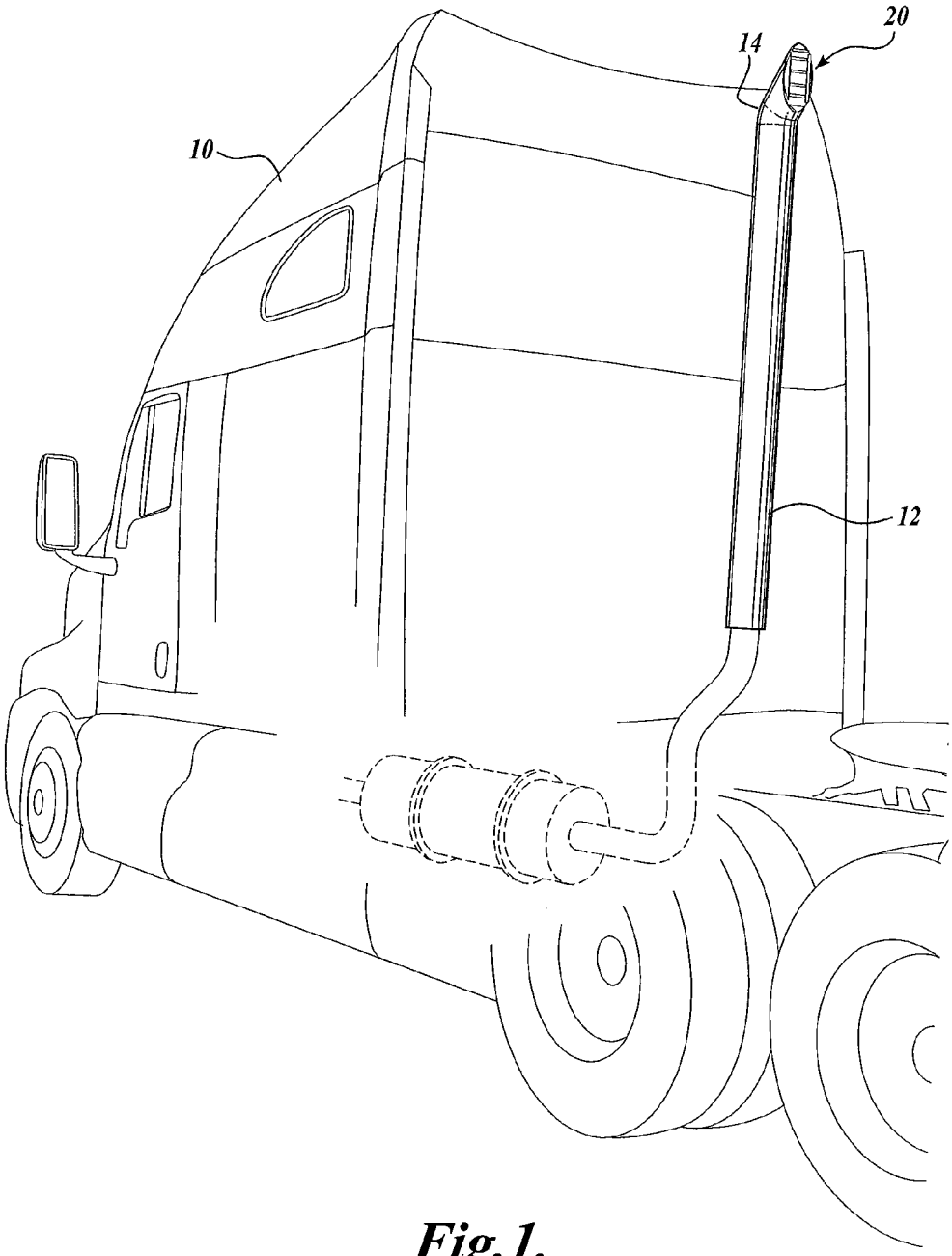
FIG. 1 is a perspective view of a flow diffuser formed in accordance with one embodiment of the present disclosure, showing the flow diffuser coupled to a vehicle of the type having an engine and an exhaust pipe.
Figure 2:
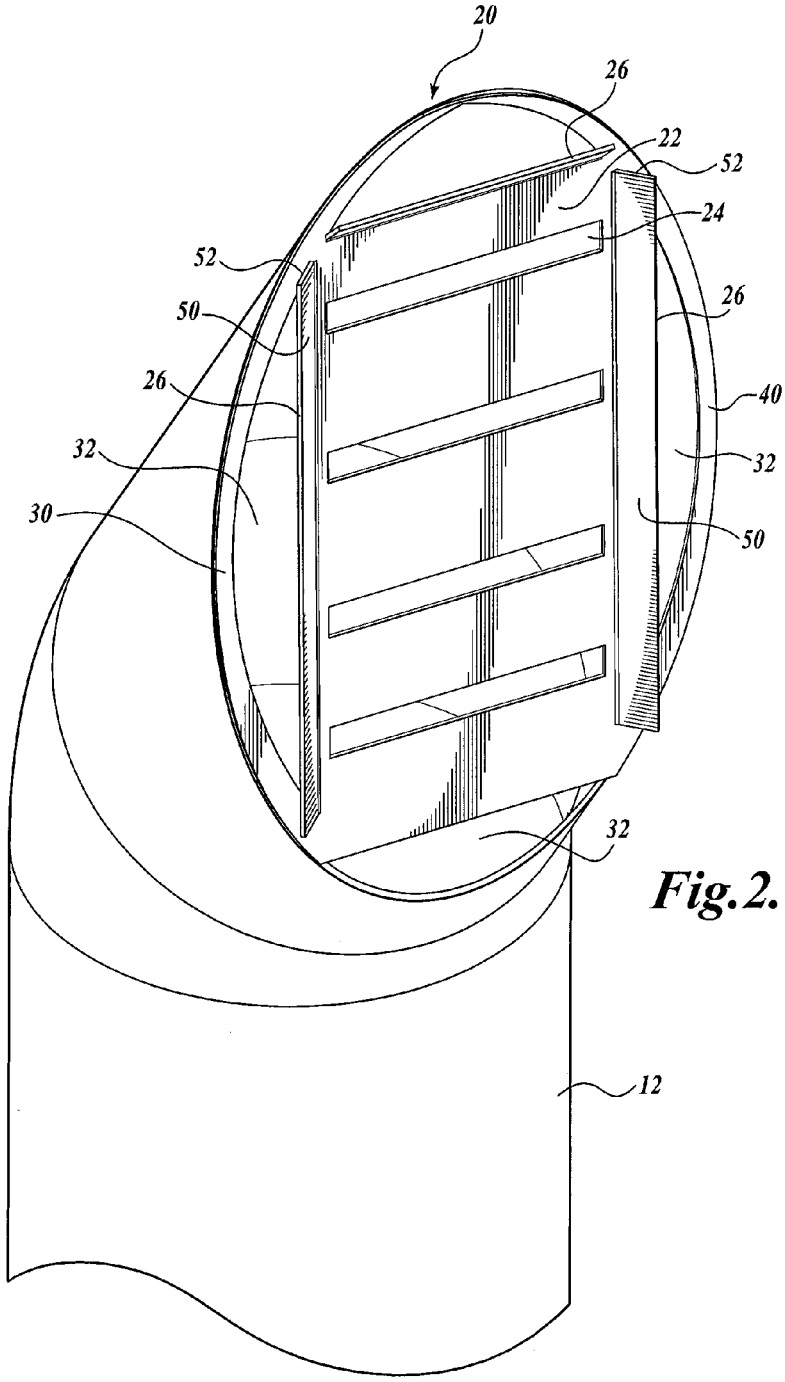
FIG. 2 is a perspective view of the flow diffuser of FIG. 1, showing the flow diffuser coupled to an exhaust pipe.
Figure 3:
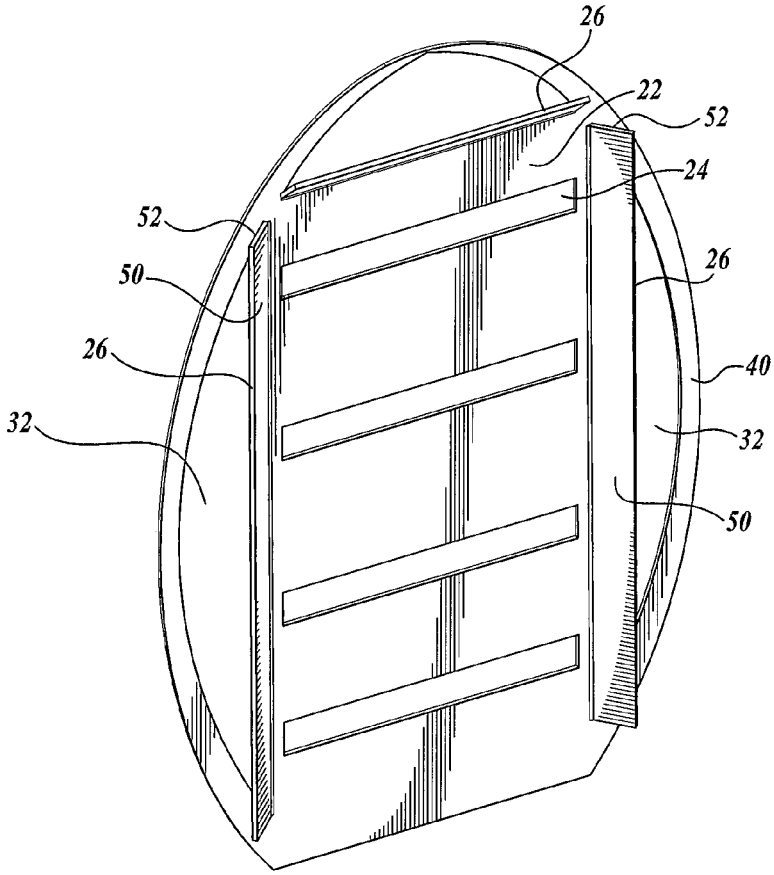
FIG. 3 is a perspective view of the flow diffuser of FIG. 1.

A flow diffuser 20 constructed in accordance with one embodiment of the present disclosure may be best understood by referring to FIGS. 1-3. The flow diffuser 20 includes a main body 22 having a plurality of inner diffusion ports 24, shown as diffusion slots extending through the body. The flow diffuser 20 further includes one or more extension flaps 26 extending from at least a portion of the outer perimeter of the body 22. The flow diffuser 20 is designed to physically interrupt the core stream in the center of the exhaust pipe 12 and promote turbulence in the exhaust stream for fluid mixing and heat dissipation.

Flow diffusers 20 of the present disclosure reduce temperature and velocity profiles of hot exhaust gas plumes after exiting an exhaust pipe 12 of a vehicle 10 to reduce the risk of danger associated with hot exhaust pipe discharge. As discussed in greater detail below, specifically, with reference to the EXAMPLE below, the embodiments described herein promote ready mixing and diffusion of hot exhaust gas with cooler surrounding ambient air for improved heat dissipation.

Although illustrated and described in conjunction with vertical (i.e., stack) exhaust pipes, other configurations, such as horizontal (i.e., under-chassis) exhaust pipes, are also intended to be within the scope of the present disclosure. In a stack exhaust pipe application, exhaust gas diffusion is important to prevent combustion of ignitable objects near the stack outlet, such as a bridge, tree, etc. In an under-chassis exhaust pipe application, exhaust gas diffusion is important to prevent injury to bystanders or damage to other vehicles or ground level objects.

It should be appreciated that the flow diffuser 20 is connectable to the exhaust pipe 12 (see FIG. 1) by any means known to those having ordinary skill in the art, including by an interference fit, welding, adhesive, or any suitable fastening devices, such as bolts, rivets, or other fasteners. In the illustrated embodiment of FIGS. 1-3, the flow diffuser 20 is coupled to a stack exhaust pipe 12, for example, a 4-inch diameter nominal pipe having a circular or oval cross section. As seen in FIGS. 1 and 2, the stack exhaust pipe 12 includes an angled portion 14 to direct the exhaust rearwardly away from the cab of the truck 10. In addition, in the illustrated embodiment the outlet of the exhaust pipe is cut along an angled plane to increase the cross-sectional flow area at the outlet end. As one non-limiting example, the outlet may have a circular or oval cross section having a 5-inch diameter.

As mentioned above, the flow diffuser 20 includes a plurality of inner diffusion ports 24 extending through the body. The inner diffusion ports 24 are shown as a plurality of longitudinal diffusion slots. In the illustrated embodiment, four diffusion slots are shown; however, it should be appreciated that any number of diffusion slots is within the scope of the present disclosure. Exhaust gas exits the diffusion ports 24 at the exit plane 30 of the flow diffuser 20, which is at or near the exit plane of the exhaust pipe 12.

Although shown as diffusion slots, it should be appreciated that the inner diffusion ports 24 may be configured in other orientations. As non-limiting examples, the diffusion ports 24 need not be longitudinal slots, but may be "V" or "U" shaped slots, serpentine slots, or any other shape of slot to improve exhaust gas diffusion. As other non-limiting examples, the diffusion ports 24 need not be slots, but may be a plurality of holes, concentric circles, or any other port shape to improve exhaust gas diffusion.

In addition to a plurality of inner diffusion ports 24 extending though the body, the flow diffuser further includes outer diffusion ports 32 created by the spacing between the body 22 of the diffuser 20 and the exhaust pipe 12. In that regard, the body 22 is sized to have a cross-sectional area that is smaller than the cross-sectional area of the exit plan of the exhaust pipe to create a plurality of outer diffusion ports 24 around the outer perimeter of the body 22 when the body 22 is coupled to the exhaust pipe 12.

In the illustrated embodiment, the body 22 of the diffuser 20 is substantially rectangular shaped and is designed to fit with a round- or oval-shaped exhaust pipe 12. In that regard, the rectangular shape of the diffuser creates outer diffusion ports 32 in the spacing at the bottom, top, and/or sides of the body 22 between the diffuser 20 and the exhaust pipe 12.

Although shown as being substantially rectangular shaped and designed to fit with a round- or oval-shaped exhaust pipe 12, it should be appreciated that the body 22 of the flow diffuser 20 may be of a variety of shapes. Non-limiting examples include, but are not limited to, circular, oval, polygonal, and other symmetrical and non-symmetrical shapes to create various different spacings between the diffuser and the exhaust pipe 12.

In the illustrated embodiment, the flow diffuser 20 includes an attachment portion 40 for attaching the flow diffuser 20 to the exhaust pipe 12 at or near the exit plane of the exhaust pipe 12. In the illustrated embodiment, the attachment portion 40 is an attachment ring coupled to the four corners of the rectangular-shaped body 22. The attachment portion 40 may be coupled to the body 22 or integrated with the body 22 into one discrete part. The attachment ring 40 may be attached to the exhaust pipe 12 by an interference fit, welding, adhesive, or any suitable fastening devices, such as bolts, rivets, or other fasteners.

Although shown in the illustrated embodiment as an outer ring, the attachment portion 40 need not be an attachment ring. In one non-limiting example, the attachment portion may be the four corners of the rectangular-shaped body, which may be directly attached to the exhaust pipe 12.

As mentioned above, the diffuser 20 also includes one or more extension flaps 26 extending from the outer perimeter of the body 22 to further direct exhaust flow by taking advantage of the Coandă Effect on flow. The Coatiă Effect is generally described as the tendency of a fluid jet to be attracted to a nearby surface. In the illustrated embodiment, the effect of the extension flaps 26 on exhaust flow patterns is two-fold. First, the exhaust flow exiting the inner diffusion ports 24 is attracted to the inner surfaces 50 of the nearby extension flaps 26, causing the flow to expand and diffuse beyond the cross-sectional area of the inner diffusion ports 24.

Second, the extension flaps 26 are angled outwardly, causing the flow from the outer diffusion ports 32 to be deflected outwardly for additional diffusion. Because the flow will also be attracted to the outer surfaces 52 of the extension flaps 26 as a result of the Coandă Effect, the flow will be deflected outwardly, but will be spread across the entire exit area of the outer diffusion ports 32 to improve exhaust gas diffusion.

Figure 4:
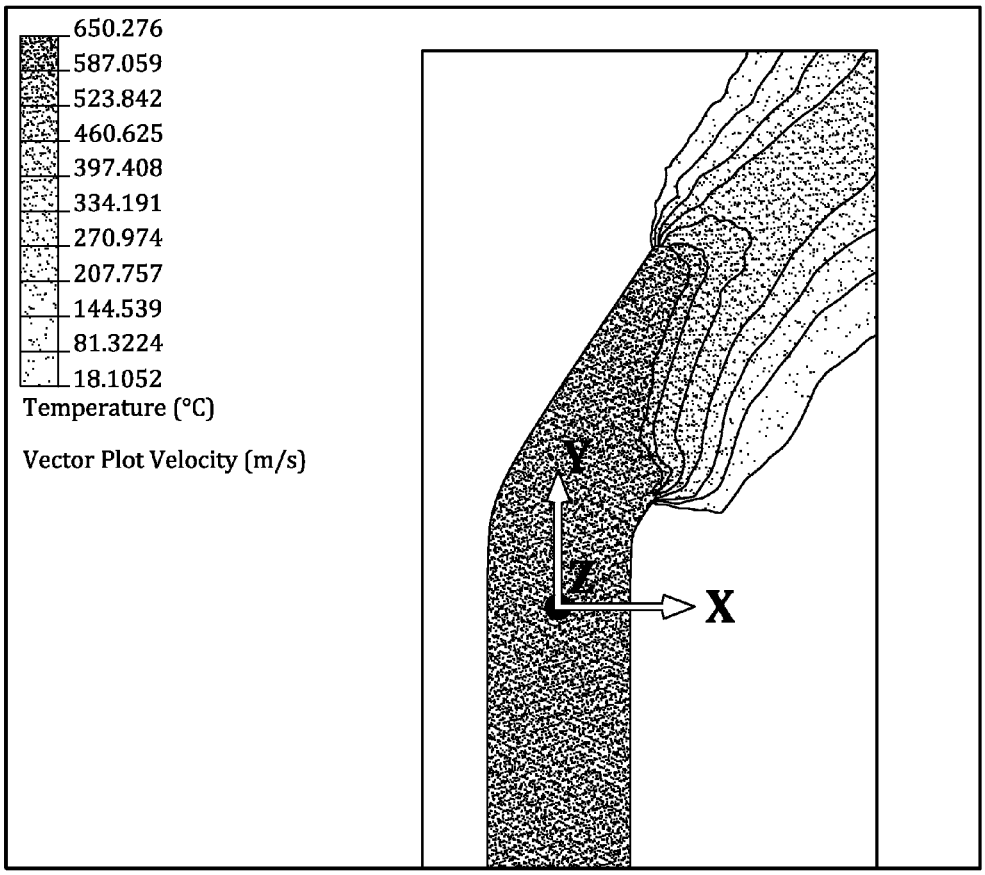
FIG. 4 is an individual computational fluid dynamics (CFD) plot for an exhaust pipe having a flow diffuser in accordance with the embodiment shown in FIG. 1.

During the operation of a vehicle, for example, the vehicle 10 shown in the illustrated embodiment of FIG. 1, exhaust gas travels through an exhaust pipe 12 and is diffused to the surrounding ambient air by the flow diffuser 20. Referring to FIG. 4, a CFD plot shows that the exhaust gases exit the diffuser in a highly turbulent state, resulting in reduced discharge temperature and plume size to improve barrier mixing and diffusion results. In the illustrated CFD plot of FIG. 4, the discharge temperature and plume size is quickly reduced from over 650 degrees Celsius (923 degrees Kelvin) to about 334 degrees Celsius (607 degrees Kelvin).

Therefore, the diffuser 20 of the illustrated embodiment is designed to have two-stage diffusion. First, the body 22 having inner diffusion ports 24 provides a restriction to slow exhaust gas flow and decrease the distance that the plume of the exhaust gas will travel. Second, the outer diffusion ports 32 and extension flaps 26 take advantage of the Coandă Effect to spread the exhaust gas over a larger exit area to result in improved diffusion results.

The heat transfer and fluid mixing promoted by the flow diffuser 20 of the illustrated embodiment of FIGS. 1-4 will now be described in greater detail. The effects of the heat transfer and fluid mixing promoted by the flow diffuser 20 can be seen in the comparative graph of FIG. 5, described in greater detail below in the EXAMPLE.

When in use, heat dissipation of hot exhaust gas is achieved through the flow diffuser 20 in at least four ways: (1) by heat conduction, (2) by velocity reduction, (3) by breaking up the exhaust stream to encourage turbulence and mixing with ambient air, and (4) by introducing ambient air into the exhaust stream. As will be described in greater detail below, velocity reduction, breaking up the exhaust stream, and mixing with ambient air, in turn, result in reduction of the center core of the hot exhaust gas streams exiting the flow diffuser 20 to promote enhanced fluid mixing upon exit. Enhanced fluid mixing results in more rapid heat dissipation of the exhaust gas with the surrounding ambient air. It should be appreciated that fluid mixing contributes more significantly to the overall heat dissipation of the flow diffuser 20 than heat dissipation by conduction (for example, heat loss through the outer surface of the exhaust pipe and flow diffuser).

First, heat is dissipated from the effective surface area of the exhaust pipe 12 and the flow diffuser 20 to the surrounding ambient air. The wall thicknesses of the flow diffuser 20 and the exhaust pipe 12, as well as the thermal resistivity of the material from which the flow diffuser 20 and exhaust pipe 12 are constructed, contribute to the conductive cooling achieved by the flow diffuser 20, in accordance with the principles of heat transfer. It should further be appreciated that additional cooling of the flow diffuser 20 surface may be achieved by convective cooling. For example, if the vehicle 10 to which the flow diffuser 20 is attached is moving, the fluid flow of the surrounding ambient air over the flow diffuser 20 will further provide cooling to the flow diffuser 20.

Second, because the flow area of the exit plane of the exhaust pipe 12 may be greater than the flow area at the inlet of the exhaust pipe 12, the velocity of the exhaust gas may decrease as it exits the flow diffuser 20. Decreased exhaust gas velocity allows for a decreased penetration distance of the jet exhaust streams, which further allows for enhanced mixing of the exhaust gas streams with the surrounding ambient air. In addition to the mixing advantages described herein, increased flow area at the exit plane of the exhaust pipe 12 also helps decrease back pressure during the vehicle exhaust stroke.

Third and fourth, heat dissipation is promoted through breaking up the exhaust stream to encourage turbulence and mixing, as well as by introducing ambient air into the exhaust stream. With regard to the mixing effects, it should be appreciated that exhaust gas generally has a nonlaminar flow at a high velocity and, comparatively, the surrounding ambient air generally has a substantially quieter flow at a lower velocity. As the exhaust gas exits the flow diffuser 20, the flow diffuser 20 creates a plurality of separate exhaust gas streams that exit through the diffusion ports 24 and 32.

Although the velocities of the separate exhaust gas streams decrease with increased flow area at the exit plane of the exhaust pipe 12, the exhaust gas still exits through the flow diffuser 20 at a substantially higher velocity than the surrounding ambient air. When the exhaust gas streams exit the flow diffuser 20, the shearing forces between the exhaust gas streams and the surrounding ambient air create a frictional drag at their barriers. This frictional drag creates a series of small vortices along the barriers of the exhaust gas streams, and the circulation of the vortices promotes mixing between the exiting streams and the surrounding ambient air to aid in the diffusion of the exhaust gas. Such mixing aids in significantly decreasing the temperature of the hot exhaust gas and the penetration distance of hot exhaust gas streams discharging from the flow diffuser 20.

The more barriers and vortices that are created and the more ambient air present at the barriers for mixing, the greater the heat diffusion of the exhaust gas. Therefore, the combination flow diversion and flow dividing as well as the introduction of ambient air promotes increased mixing of the exhaust gas with ambient air after exiting the flow diffuser 20. In addition, if the vehicle 10 to which the flow diffuser 20 is attached is moving, the fluid mixing may be even more enhanced by the introduction of convective mixing principles, described above.

Example

Comparative Exhaust Temperatures

Figure 5:
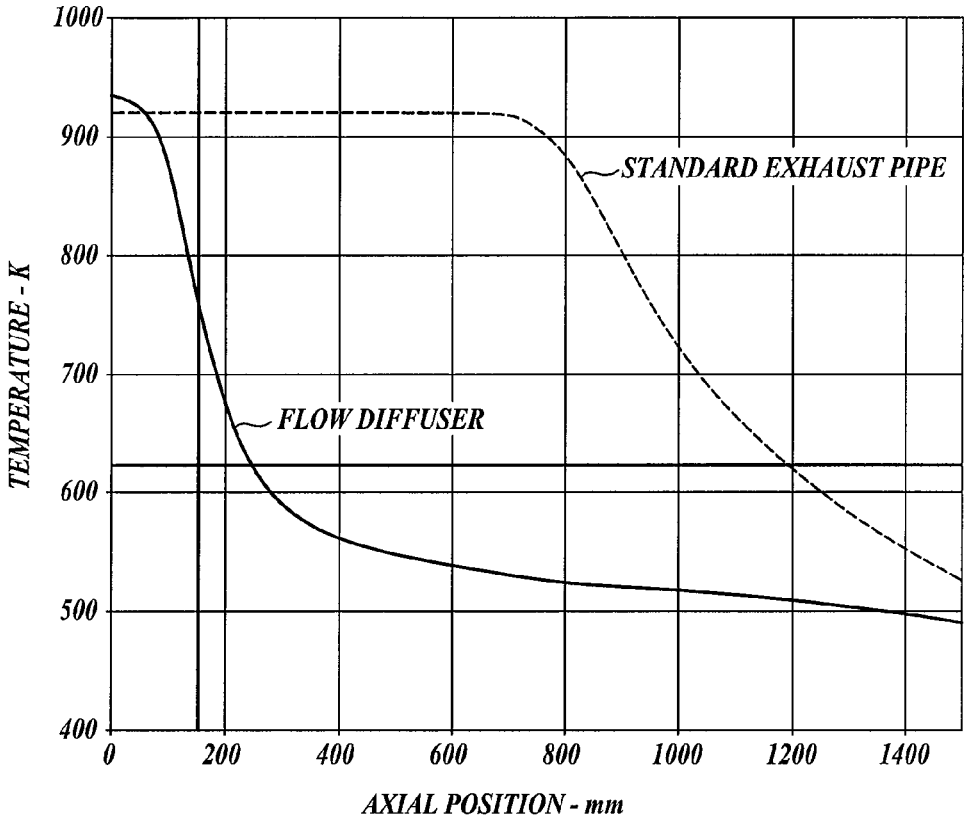
FIG. 5 is a comparison graph plotting exhaust gas exit temperature versus the distance the exhaust gas has traveled from the exit plane for the flow diffuser of FIG. 1 and a standard exhaust pipe not having a flow diffuser.

The heat transfer and fluid mixing promoted by the flow diffuser embodiments described herein may be further understood by referring to the comparison graph shown in FIG. 5, which plots exemplary exhaust gas exit temperatures versus the distance the exhaust gas has traveled from the exit plane for the flow diffuser of FIG. 1 and a standard straight diameter exhaust pipe not having a flow diffuser.

Referring to the exemplary data in FIG. 5, the hot core of the exhaust gas streams exiting the flow diffuser 20 has immediate heat dissipation from over 900 degrees Kelvin to less than about 600 degrees Kelvin within a distance of less than about 300 mm from the rear exit plane of the exhaust pipe 12 and flow diffuser 20. The hot core of the exhaust gas stream exiting the standard exhaust pipe (without a flow diffuser), on the other hand, has little to no heat dissipation from over 900 degrees Kelvin to less than 600 degrees Kelvin until the exhaust gas reaches an axial distance of over 1200 mm from the exit plane of the exhaust pipe.

The comparative graph indicates that there is significantly less mixing between the exhaust gas and the surrounding ambient air at the barrier of the hot core of the exhaust gas stream from a standard exhaust pipe, as compared to the mixing achieved with the flow diffuser 20 of FIG. 1, described above. Less mixing at the standard exhaust pipe outlet is a result of the substantially constant velocity of the exhaust gas at the exhaust pipe inlet and outlet for a standard exhaust pipe having a circular cross section. Therefore, the hot spot remains a penetrating jet of hot exhaust gas, even after traveling a vertical distance of over 700 mm from the exit plane.

Accordingly, it can be seen that the mixing and heat dissipation effects of the flow diffusers formed in accordance with embodiments of the present disclosure are significantly improved over the mixing and heat dissipation effects of a standard exhaust pipe.

While illustrative embodiments have been illustrated and described, it will be appreciated that various changes can be made therein without departing from the spirit and scope of the disclosure.

The embodiments of the disclosure in which an exclusive property or privilege is claimed are defined as follows:

1. A flow diffuser for vehicles of the type having an engine and an exhaust pipe, the flow diffuser comprising:

(a) a body including a plurality of inner diffusion ports extending through the body, wherein the body is attachable to an exhaust pipe at or near the exit plane of the exhaust pipe and transverse to the flow of exhaust through the exhaust pipe, wherein the body is polygonal in shape and mates with the outer perimeter of the exhaust pipe at a plurality of points, and wherein the body is sized to have a cross-sectional area that is smaller than the cross-sectional area of the exit plane of the exhaust pipe to create a plurality of outer diffusion ports around at least a portion of the outer perimeter of the body when coupled to the exhaust pipe between adjacent points; and (b) one or more extension flaps extending from at least a portion of the outer perimeter of the body.

2. The flow diffuser of claim 1, wherein the plurality of inner diffusion ports are a plurality of diffusion slots extending through the body.

3. The flow diffuser of claim 2, wherein the plurality of diffusion slots are longitudinal diffusion slots.

4. The flow diffuser of claim 1, wherein the body is rectangular in shape.

5. The flow diffuser of claim 1, further comprising an attachment portion for attaching the body to the exhaust pipe.

6. The flow diffuser of claim 5, wherein the attachment portion is an attachment ring.

7. The flow diffuser of claim 1, wherein the extension flaps extend from the body at an angle.

8. The flow diffuser of claim 1, wherein the extension flaps are configured for creating a Coandă Effect to diffuse exhaust gas temperature and plume size

9. A flow diffuser for vehicles of the type having an engine and an exhaust pipe, the flow diffuser comprising:

(a) a body including a plurality of inner diffusion slots extending through the body, wherein the is attachable to an exhaust pipe at or near the exit plane of the exhaust pipe and transverse to the flow of exhaust through the exhaust pipe, wherein the body is sized to have a cross-sectional area that is smaller than the cross-sectional area of the exit plane of the exhaust pipe to create a plurality of outer diffusion ports around the outer perimeter of the body when coupled to the exhaust pipe, wherein the body is rectangular in shape and mates with the outer perimeter of the exhaust pipe at a plurality of points; and (b) one or more extension flaps extending from at least a portion of the outer perimeter of the body.

10. A flow diffuser for vehicles of the type having an engine and an exhaust pipe, the flow diffuser comprising:

(a) a body including a plurality of inner diffusion ports extending through the body, wherein the body is attachable to an exhaust pipe to be coving at least a portion of the exit plane of the exhaust pipe, wherein the body is sized to have a cross-sectional area that is smaller than the cross-sectional area of the exit plane of the exhaust pipe to create a plurality of outer diffusion ports around at least a portion of the outer perimeter of the body when coupled to the exhaust pipe; and (b) one or more extension flaps extending from at least a portion of the outer perimeter of the body.

* * * * *

UNITED STATES PATENT AND TRADEMARK OFFICE

CERTIFICATE OF CORRECTION

PATENT NO. : 8,402,758 B2
APPLICATION NO. : 12/718598
DATED : March 26, 2013
INVENTOR(S) : J. Castner et al.

It is certified that error appears in the above-identified patent and that said Letters Patent is hereby corrected as shown below:

In the Claims

| COLUMN | LINE | ERROR |
|---|---|---|
| 6 (Claim 8, | 56 line 2) | after "size" insert --.-- |
| 6 (Claim 9, | 60 line 4) | after "wherein the" insert --body-- |
| 7 (Claim 10, | 10 line 5) | "coving" should read --covering-- |

Signed and Sealed this
Fifteenth Day of April, 2014

Michelle K. Lee

Michelle K. Lee
*Deputy Director of the United States Patent and Trademark Office*